US011259616B2

(12) United States Patent
Bickford et al.

(10) Patent No.: US 11,259,616 B2
(45) Date of Patent: Mar. 1, 2022

(54) COSMETIC PACKAGE INCLUDING A LIQUID RESERVOIR

(71) Applicant: L'Oreal, Paris (FR)

(72) Inventors: William Bickford, Scotch Plains, NJ (US); Nicholas Fodor, New York, NY (US); Rogena El-Sayed, Bayonne, NJ (US)

(73) Assignee: L'Oreal, Paris (FR)

( * ) Notice: Subject to any disclaimer, the term of this patent is extended or adjusted under 35 U.S.C. 154(b) by 379 days.

(21) Appl. No.: 16/453,736

(22) Filed: Jun. 26, 2019

(65) Prior Publication Data

US 2020/0405037 A1 Dec. 31, 2020

(51) Int. Cl.

*A45D 34/04* (2006.01)
*A45D 34/00* (2006.01)
*A45D 34/06* (2006.01)

(52) U.S. Cl.

CPC ..... *A45D 34/04* (2013.01); *A45D 34/06* (2013.01); *A45D 2034/002* (2013.01); *A45D 2034/005* (2013.01); *A45D 2200/05* (2013.01); *A45D 2200/1018* (2013.01)

(58) Field of Classification Search

CPC ..... A45D 34/04; A45D 2200/1018; A45D 2034/005; A45D 34/06; A45D 2034/002; A45D 2040/0006; A45D 34/00; A45D 2200/05; B65D 25/20; B65D 25/205; B65D 75/54; B65D 75/75; B65D 75/58

USPC ..... 401/123, 125; 206/216, 581, 226, 225; 220/69, 735, 736

See application file for complete search history.

(56) References Cited

U.S. PATENT DOCUMENTS 1,615,319 A * 1/1927 Wynn ..... B65D 81/3205 206/229
2,292,413 A * 8/1942 Taylor ..... B65D 23/14 206/229
4,651,890 A * 3/1987 Coker ..... B08B 1/00 215/6
6,302,608 B1 * 10/2001 Holmes ..... A46B 11/00 206/361
7,585,125 B2 * 9/2009 Muhlhausen ..... B65D 23/12 401/123

* cited by examiner

*Primary Examiner* — David J Walczak
(74) *Attorney, Agent, or Firm* — Christensen O'Connor Johnson Kindness PLLC

(57) ABSTRACT

Cosmetic formula containers generally include a compartment to store and retain a plurality of applicators. In one aspect, the cosmetic formula container includes a container body configured to retain a portion of a cosmetic formula within a cavity and a neck configured to receive a cap for closure of the container body. The container body includes an indentation extending from the container body into the cavity to form a compartment. The compartment is generally open at a proximal end and closed at a distal end such that the cosmetic formula in the cavity does not flow into the compartment. In some aspects, the compartment has a profile configured to retain a plurality of applicators therein.

14 Claims, 7 Drawing Sheets

COSMETIC PACKAGE INCLUDING A LIQUID RESERVOIR

SUMMARY

The present disclosure is directed to, among other things, representative embodiments of a cosmetic formula container having a compartment to store and retain a plurality of applicators. In an embodiment, the cosmetic formula container includes a container body configured to retain a portion of a cosmetic formula within a cavity. In these embodiments, the container body may have a neck configured to receive a cap for closure of the container body, and an indentation extending from the container body into the cavity to form a compartment. The compartment is generally open at a proximal end and closed at a distal end such that the cosmetic formula in the cavity does not flow into the compartment. In some embodiments, the compartment has a profile configured to retain a plurality of applicators therein.

The present disclosure is also directed to one or more embodiments of a cosmetic formula container having a container body configured to retain a portion of a cosmetic formula within a cavity. In these embodiments, the container body has a neck and a base, and includes a cap releasably couplable to the neck for closure of the container body. In embodiments, the cosmetic formula container has an indentation extending from the container body into the cavity to form a compartment having an open proximal end and closed distal end such that the cosmetic formula in the cavity does not flow into the compartment, and a plurality of applicators positioned within the compartment.

In accordance with any of the embodiments described herein, the cosmetic formula container may further comprise a cartridge having a cooperating shape with the cavity such that the cartridge is configured to insert within the cavity, wherein the cartridge may be configured to retain the plurality of applicators.

In accordance with any of the embodiments described herein, the cartridge may have a retention feature to retain the cartridge within the compartment, the retention feature selected from the group consisting of interference fit, snap fit, thread, and twist to lock.

In accordance with any of the embodiments described herein, the indentation may be positioned in a base portion of the container body to form the compartment.

In accordance with any of the embodiments described herein, a profile of the compartment may have a shape selected from the group consisting of oval, elliptical, non-circular, and arcuate.

In accordance with any of the embodiments described herein, the profile may be oval or elliptical and the plurality of applicators may deform to a hyperbolic paraboloid shape such that the plurality of applicators are retained within the compartment by friction.

In accordance with any of the embodiments described herein, the indentation may be positioned in a side portion of the container body to form the compartment.

In accordance with any of the embodiments described herein, an opening of the indentation in the side portion of the container body is narrower than the plurality of applicators such that the applicators are retained within the compartment by interference.

In accordance with any of the embodiments described herein, the cosmetic formula container may further comprise a removable cover over an opening of the indentation to enclose the compartment and retain the plurality of applicators therein.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following description provides several examples that relate to cosmetic formula containers having one or more compartments for storage of a plurality of applicators. Application of a wide variety of cosmetic formulas to a person's face, hair, skin, nails, etc. ("keratinous materials") is a common practice. Some examples of such cosmetic formulas include moisturizers, conditioners, proteins, oils, cleansers, solvents, foundation, blushes, shadow, etc. To apply the cosmetic formula, an applicator can be used. The applicators described for use with the cosmetic formula containers herein include pads, wipes, clothes, sponges, or the like, which are substantially flat and typically constructed of a porous material to retain formula for application to the keratinous material, or for removal of materials from the skin of a user. In some embodiments, the applicators However, embodiments of the cosmetic formula containers described herein are suitable for storage of any applicator type within the compartment, such as plastic, metal, and fabric applicators, or items other than applicators, such as swabs, bandages, spoons, spatulas, tweezers, etc. In some embodiments, the applicators are pliable, such that the applicator can be manipulated to conform to a variety of surface topography.

Figure 1:
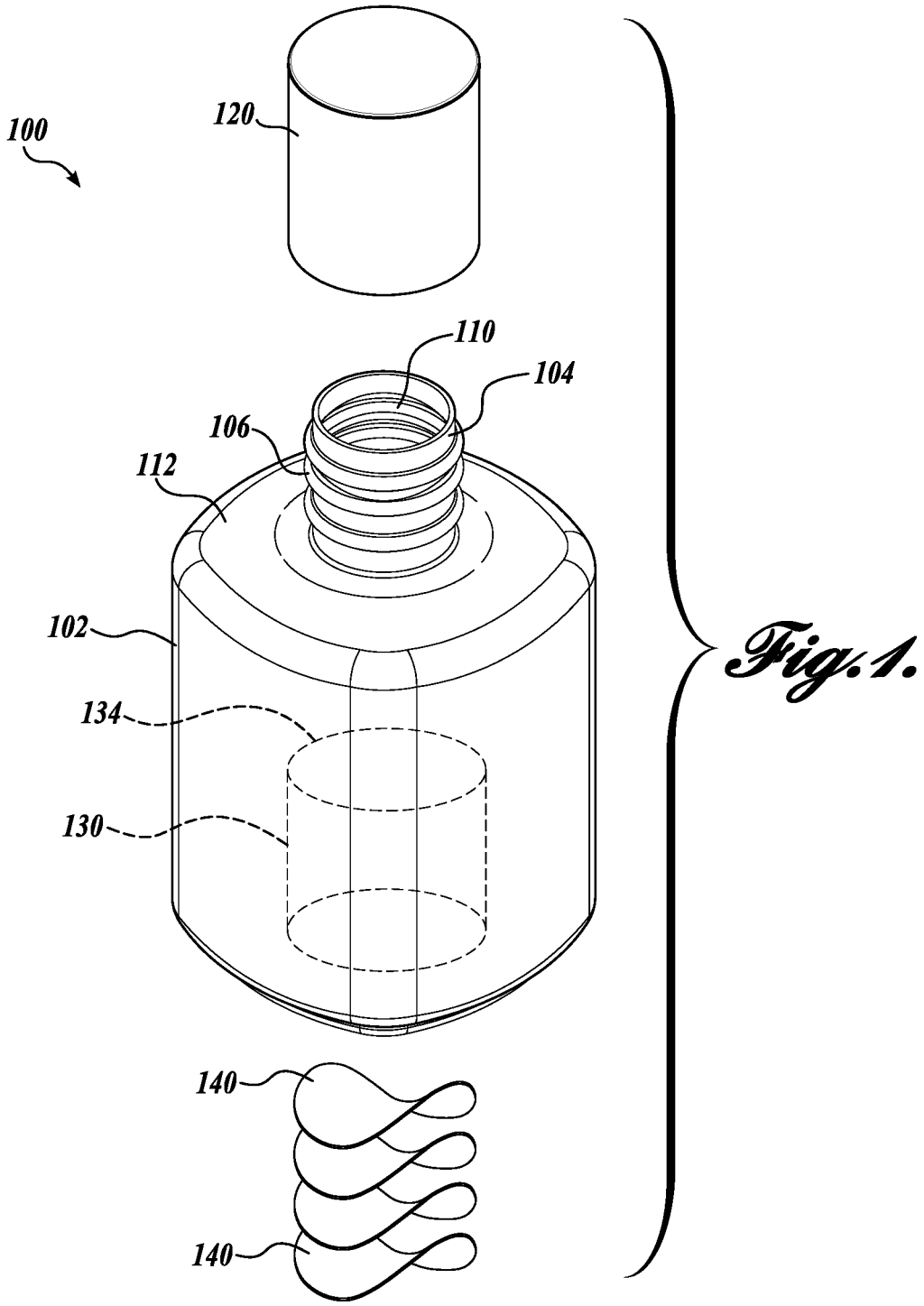
FIG. 1 is an exploded perspective view of one representative embodiment of a cosmetic formula container having a storage compartment in accordance with an aspect of the present disclosure.

FIG. 1 shows one representative embodiment of a cosmetic formula container having a compartment for storage of a plurality of applicators for implementing one or more methodologies or technologies such as, for example, providing a cosmetic formula and an applicator in a single package. In some embodiments, the plurality of applicators may be stored in an open or closable compartment within the cosmetic formula container. Conventional cosmetic formula containers are unable to readily store a plurality of applicators, which requires a user to carry separate packaging for the cosmetic formula and the applicators.

Accordingly, to address the deficiencies in conventional cosmetic formula containers, and others, embodiments of the present disclosure relate to a cosmetic formula container with an applicator storage feature to retain a plurality of applicators within the cosmetic formula container. To achieve these benefits and others, embodiments of the cosmetic formula container disclosed herein include a compartment for storage of one or more applicators within the cosmetic formula container.

The embodiments illustrated in the FIGURES have been designed for use with cosmetic formula containers for carrying a variety of cosmetic formulas, e.g., moisturizers, conditioners, proteins, oils, cleansers, solvents, etc. Embodiments of the present disclosure are also suitable for carrying any formula.

Embodiments of the cosmetic formula containers disclosed herein generally include a neck and an interior cavity configured to hold a quantity of cosmetic formula and a compartment separated from the cosmetic formula and configured to store a plurality of applicators. The neck is configured to interface with a cap in a removably couplable manner for enclosing the cosmetic formula within the bottle. In certain embodiments disclosed herein, the cosmetic formula bottle is about 25 centimeters or smaller in height, about 10 centimeters or smaller in width or diameter, and contains less than 1 liter of cosmetic formula. In certain embodiments disclosed herein, the cosmetic formula bottle is about 15 centimeters or smaller in height, about 7.5 centimeters or smaller in width or diameter, and contains less than 0.5 liters of cosmetic formula. In an embodiment, a major dimension of the cosmetic formula bottle ranges from about 2 centimeters to about 15 centimeters. In an embodiment, a major dimension of the cosmetic formula bottle ranges from about 2 centimeters to about 7 centimeters. In an embodiment, the volume of the cosmetic formula bottle ranges from about 0.08 fluid ounces (fl. oz.) to about 20 fl. oz. In an embodiment, the volume of the cosmetic formula bottle ranges from about 0.08 fluid ounces (fl. oz.) to about 3 fl. oz. In an embodiment, the volume of the cosmetic formula bottle ranges from about 0.08 fluid ounces (fl. oz.) to about 1 fl. oz. In an embodiment, the volume of the cosmetic formula bottle ranges from about 0.08 fluid ounces (fl. oz.) to about 0.5 fl. oz. In an embodiment, the volume of the cosmetic formula bottle ranges from about 2.5 milliliters (ml) to about 600 ml. In an embodiment, the volume of the cosmetic formula bottle ranges from about 2.5 milliliters (ml) to about 100 ml. In an embodiment, the volume of the cosmetic formula bottle ranges from about 2.5 milliliters (ml) to about 50 ml. In an embodiment, the volume of the cosmetic formula bottle ranges from about 2.5 milliliters (ml) to about 15 ml.

Figure 2:
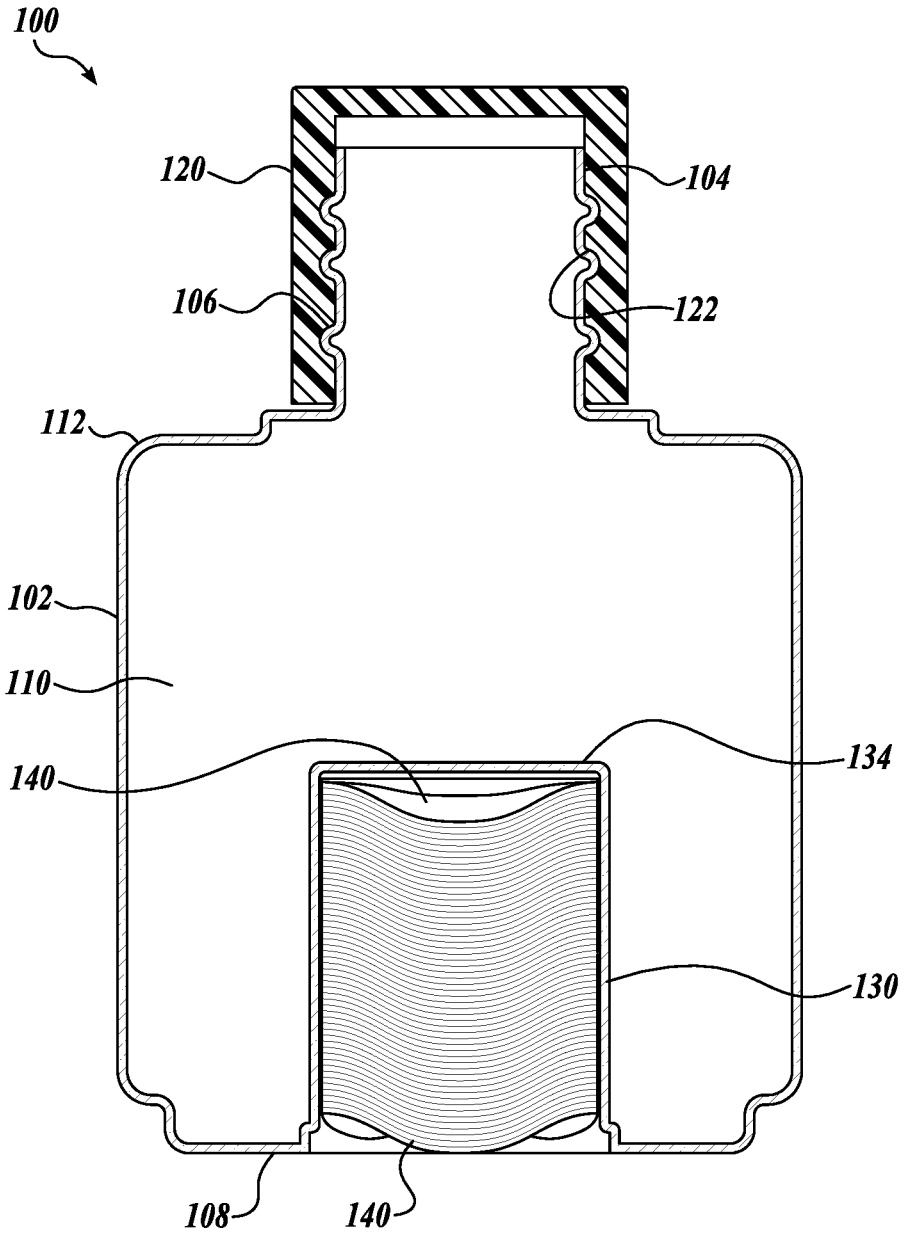
FIG. 2 is an assembled cutaway side view of the cosmetic formula container of FIG. 1.
Figure 3:
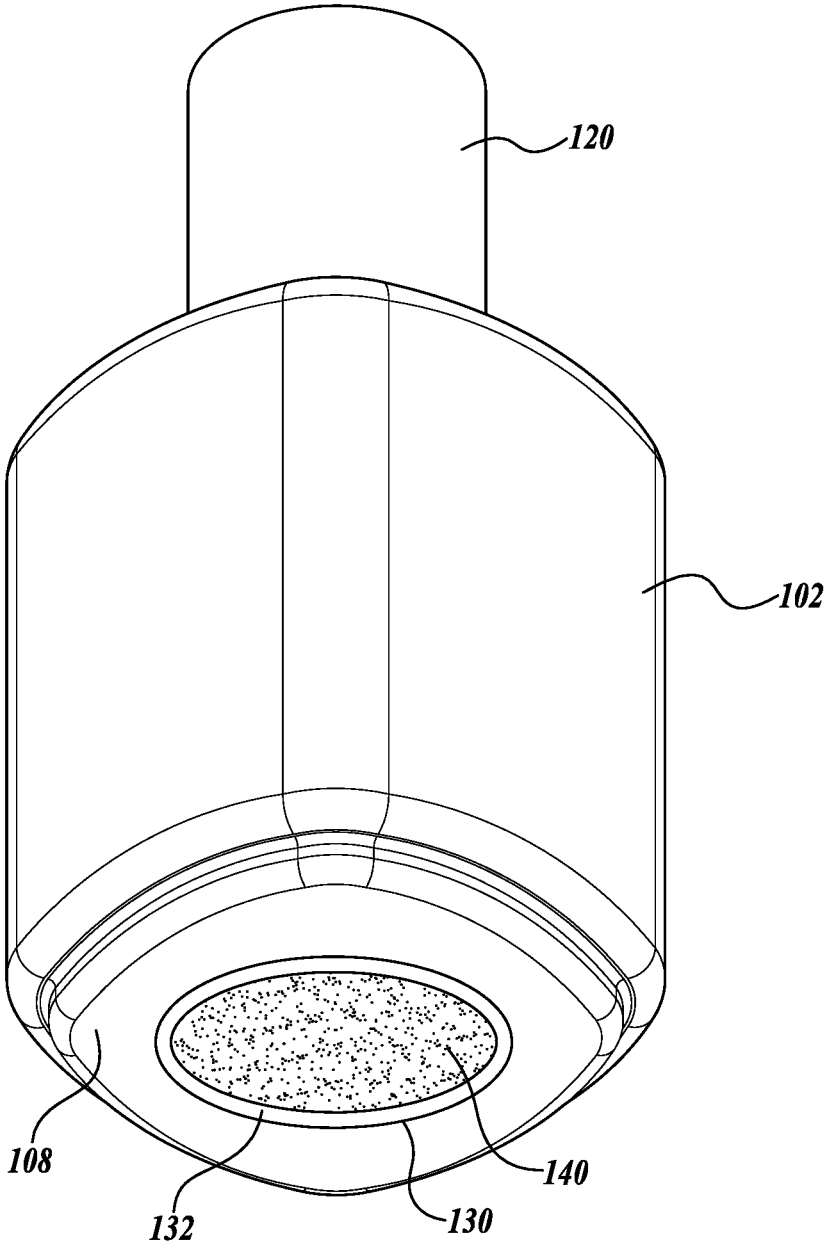
FIG. 3 is an assembled perspective view of the cosmetic formula container of FIG. 1.

Referring now to FIGS. 1-3, there is shown one embodiment of a cosmetic formula container, generally designated 100, in accordance with one or more aspects of the present disclosure. In the illustrated embodiment, the cosmetic formula container 100 includes a cap 120 and a cosmetic bottle 102. When the cap 120 is assembled to the cosmetic bottle 102, the cosmetic formula container 100 is configured to retain an amount of cosmetic formula without spilling or leaking the material. In some embodiments, the cosmetic bottle 102 is formed from a polymer such as polyethylene terephthalate (PET), polyethylene (PE), or polypropylene (PP) and may be formed from blow molding techniques such as injection blow, extrusion blow, or stretch blow molding for example. In some embodiments, the cap 120 includes an actuator for dispensing the cosmetic formula, such as a spray, pump, nozzle, dropper, etc.

Each component of the container 100 will now be described in more detail. FIGS. 1-3 illustrate one embodiment of the container 100 in accordance with an aspect of the present disclosure. As described above, embodiments of the cosmetic container 100 include the cap 120 and a cosmetic bottle 102. The cosmetic bottle 102 includes bottle body 112 that forms an interior cavity 110 configured to hold a preselected quantity of cosmetic formula. Non-limiting examples of formulas include cosmetic formulations, solvents, nail polish remover, make-up compounds, soap, treatment formulations, nail care formulation, cosmetic products, care products, Ultraviolet (UV) curable cosmetic nail gel compositions, anti-fungal compositions, color cosmetic compositions, nail-care cosmetic formulations, lip-care cosmetic formulations, eye-cosmetic formulations, eye-treatment compositions, facial and body cleansers, anti-acne formulations, photo-protection or sun protection, self-tanning compositions, make-up removal formulas, wound cleansing/hygiene formulas, and the like. Although one type of cosmetic bottle 102 is illustrated and described herein, any suitable shape, size, and design of a cosmetic container may be used with the embodiments of the present disclosure.

Further non-limiting examples of formulas include cuticle care formulations (e.g., apricot cuticle oil formations, hydrating formulations, and the like); based coat formulations (e.g., strengtheners, rubber adhesives, primers, color adhesives, anti-break compositions, ridge fillers, and the like); treatment formulations (e.g., nutra-keratin formulations, bamboo extract formulations, ridge filler formulations, anti-chip formulations, and the like); top coat formulations (e.g., GEL•SETTER™, shine, polish, matte finisher, anti-chip, color adhesive, primer, quick drying, and the like); and products and formulas to remove these formulations; and the like. In one embodiment, the cosmetic formula includes nail care cosmetic compositions.

The cosmetic bottle also includes the neck 104 for interfacing with the cap 120. In some embodiments, the neck 104 extends from the bottle body 112 with a smaller cross-section than the bottle body 112. The cap 120 selectively attaches to the neck 104 of the cosmetic bottle 102 using a mechanical coupling, such as press fit, turn to lock, threads interlock, etc. In the illustrated embodiment shown in FIG. 2, the cap 120 selectively attaches via internal applicator threads 122 that engage the cooperatingly configured bottle threads 106 disposed on the neck 104. In several embodiments, the cap 120 is configured to closely interface with the neck 104 to provide a hermetic seal, keeping the cosmetic formula from escaping the bottle cavity 110, evaporating, etc.

As shown in FIGS. 1-3, the cosmetic bottle 102 has a base 108 to support the cosmetic bottle 102 on a surface, such as a countertop. In some embodiments, the cosmetic bottle 102 includes a protrusion extending from the base 108 into the bottle cavity 110 to form an applicator compartment 130. The applicator compartment 130 has an open proximal end 132 and a closed distal end 134 such that the cosmetic formula in the bottle cavity 110 does not enter the applicator compartment 130. As shown in FIG. 2, a plurality of applicators 140 may be inserted into the applicator compartment 130 for storage of applicators 140 with the cosmetic formula container 100. The depth of the applicator compartment 130 is suitably any depth to hold a desired number of applicators 140. The applicator compartment 130 is suitable centered on the base 108, or offset from the center of the base 108.

In the illustrated embodiment of FIGS. 1-3, the applicator 140 is substantially circular. In embodiments where the proximal end 132 of the applicator compartment 130, the profile of the applicator compartment 130 may be shaped to deform the applicators 140 and configuration that retains the applicators 140 within the applicator compartment 130 until an applicator 140 is removed by the user. In these embodiments, the applicator compartment 130 may have a profile that is oval, elliptical, non-circular, arcuate, axially symmetric, or other suitable profiles to retain the applicators 140 within the applicator compartment 130. In the embodiments with oval analytical profiles, the applicator 140 may deform to a hyperbolic paraboloid shape. With the shape, the elastic restoration forces apply a force against the wall of the applicator compartment 130 to retain the applicators 140 within the applicator compartment 130 by friction. In these embodiments, the proximal end 132 of the applicator compartment 130 may include a closure portion, such as a sticker, label, sliding door, or stopper to enclose the applicator compartment 130. In other embodiments, other deformed shapes of the applicators 140 are within the scope of the present disclosure.

Figure 4:
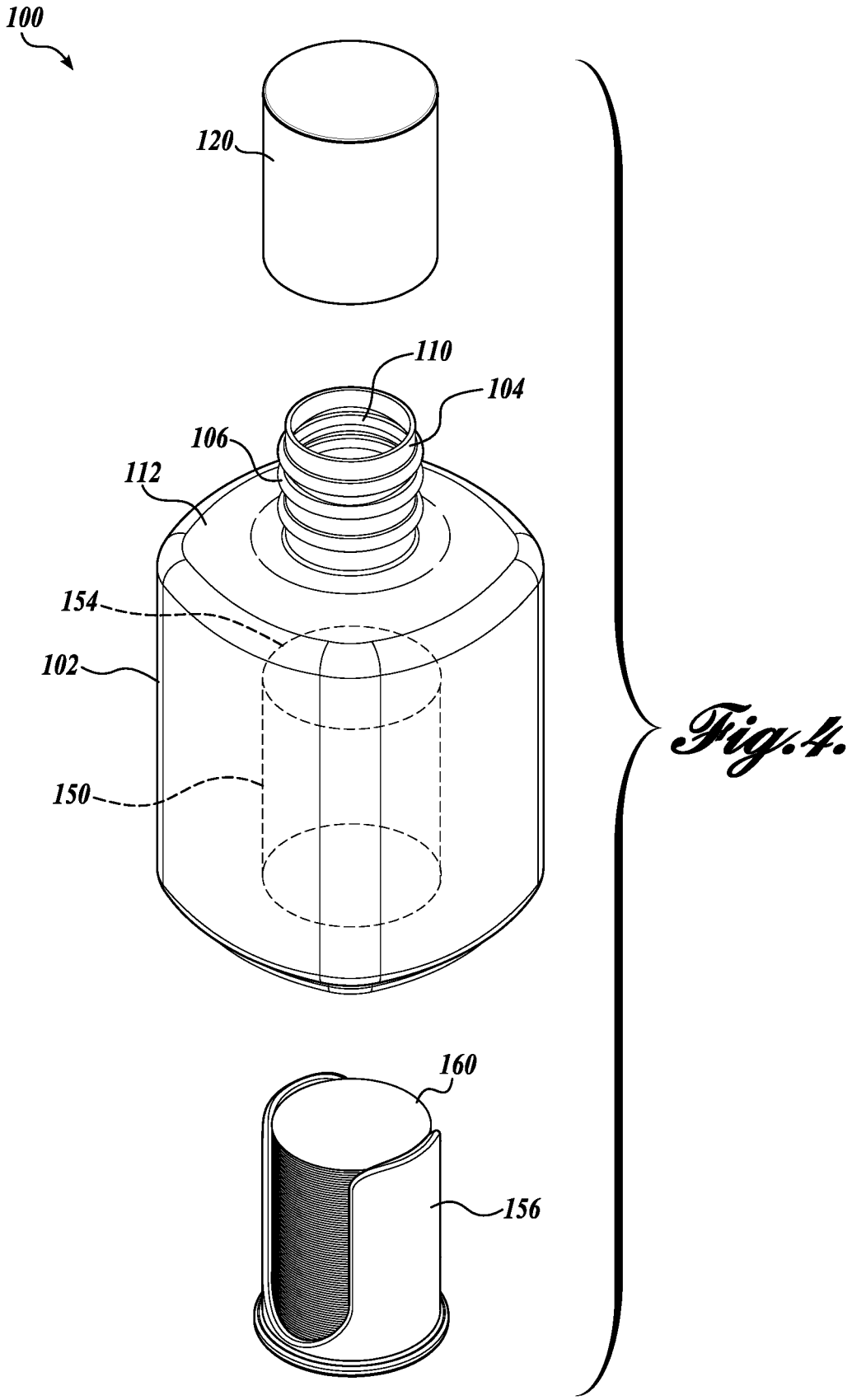
FIG. 4 is an exploded perspective view of another representative embodiment of a cosmetic formula container having a storage compartment in accordance with an aspect of the present disclosure.
Figure 5:
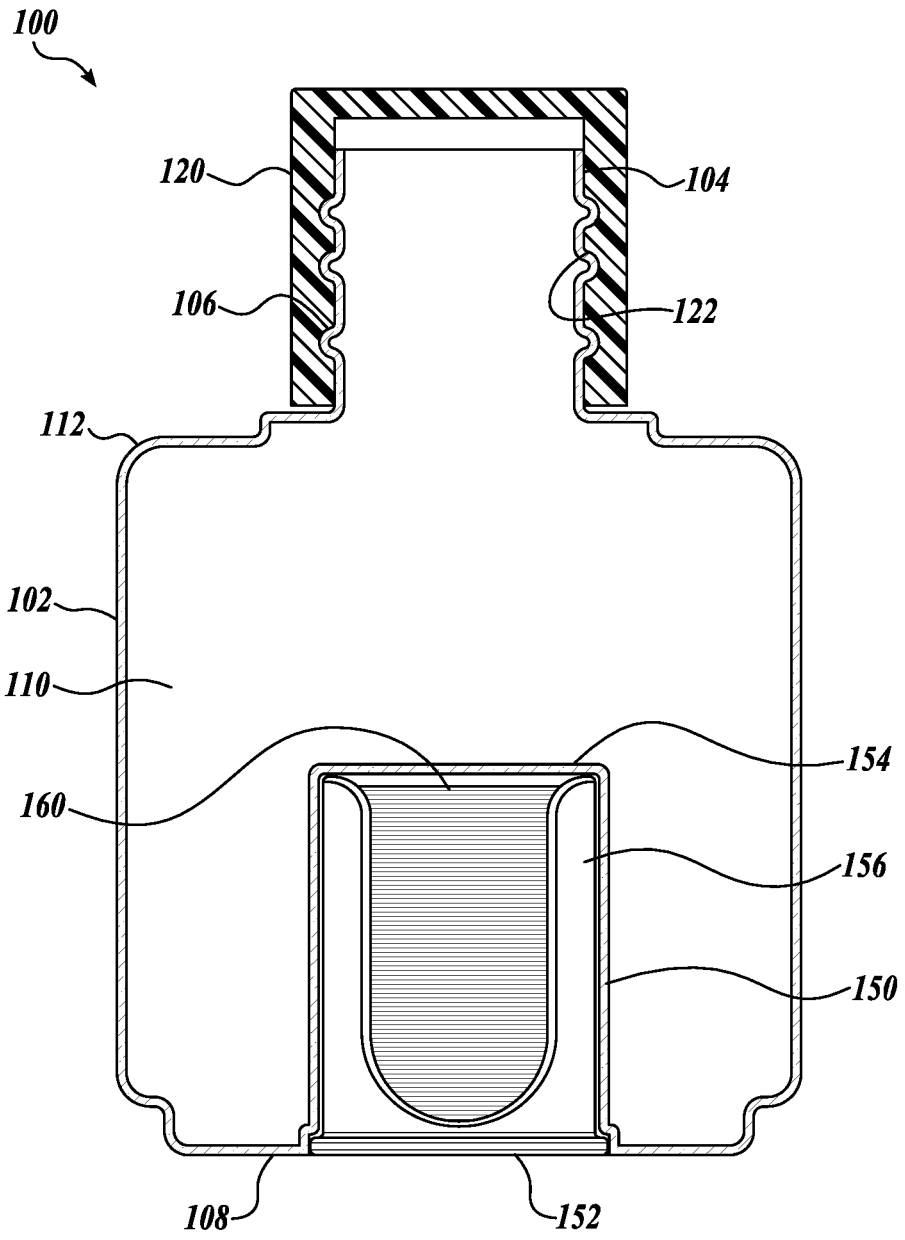
FIG. 5 is an assembled cutaway side view of the cosmetic formula container of FIG. 4.
Figure 6:
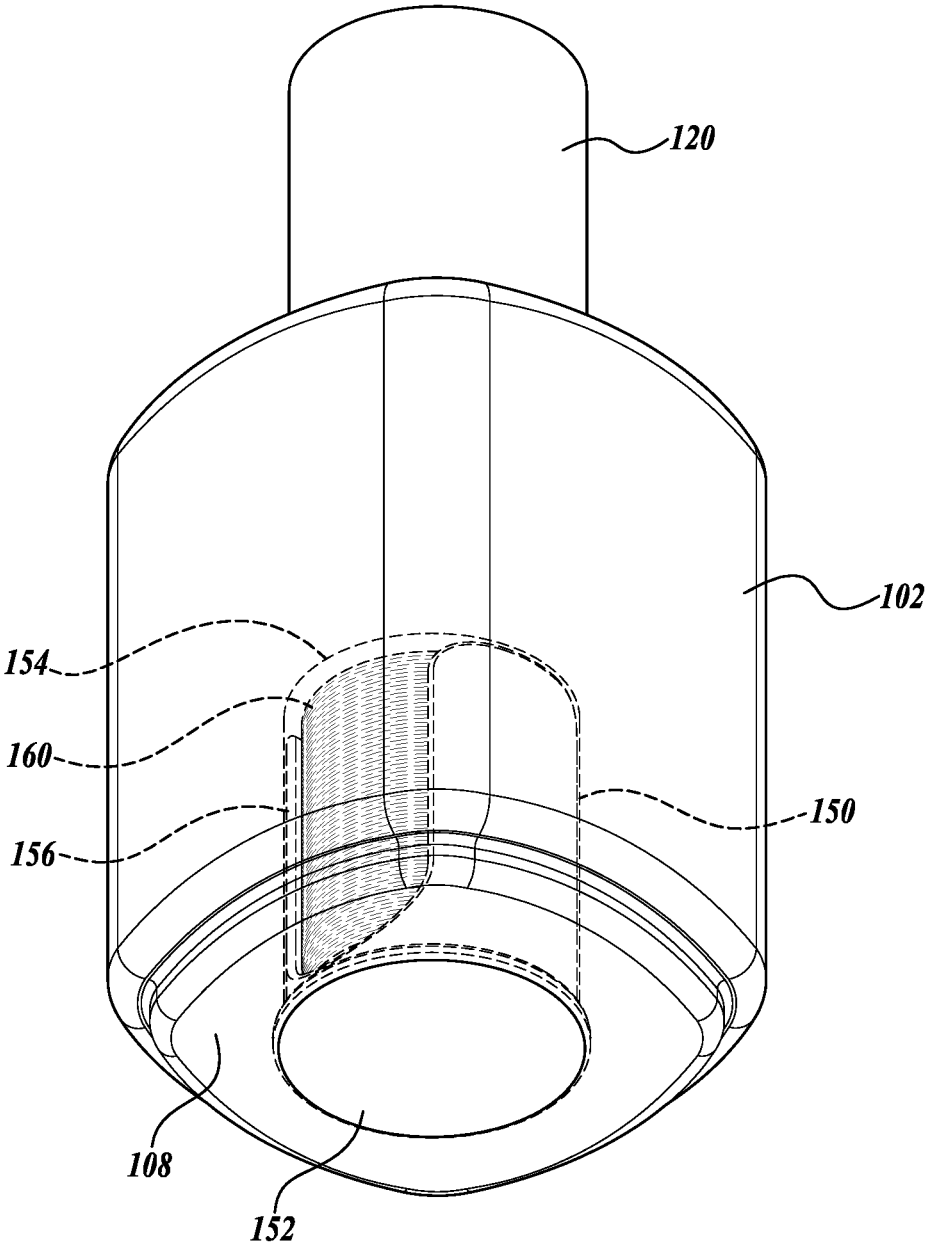
FIG. 6 is an assembled perspective view of the cosmetic formula container of FIG. 4.

Turning to FIGS. 4-6, another embodiment of the cosmetic formula container 100 is shown. The embodiment shown in FIGS. 4-6 is substantially similar to the embodiments shown in FIGS. 1-3, with changes to the applicator compartment. In these embodiments, the cosmetic bottle 102 includes a protrusion extending from the base 108 into the bottle cavity 110 to form an applicator compartment 150. The applicator compartment 150 has an open proximal and 152 and a closed distal end 154 such that the cosmetic formula in the bottle cavity 110 does not enter the applicator compartment 130. The depth of the applicator compartment 150 is suitably any depth to hold a desired number of applicators 140. The applicator compartment 150 is suitable centered on the base 108, or offset from the center of the base 108.

In the embodiments shown, the applicator compartment 150 is configured to accept an applicator cartridge 156 therein. The applicator cartridge 156 is sized and shaped to carry a plurality of applicators 160 such that the applicators 160 in the applicator cartridge 156 can be inserted into the applicator compartment 150 for storage of the applicators 160 within the cosmetic bottle 102. In these embodiments, the applicator compartment 150 may have a profile that is substantially circular. However, in other embodiments, the profile of the applicator compartment 150 may be any suitable shape that is complementary to the shape of the applicator cartridge 156. In these embodiments, the cosmetic bottle 102 and the applicator cartridge 156 may include retention features (not shown) to retain the applicator cartridge 156 within the cosmetic bottle 102. In some embodiments, the retention feature is suitably an interference fit, snap fit, thread, twist to lock, or other suitable retention feature. In some embodiments, the applicator cartridge 156 may be formed from the same material as the cosmetic bottle 102. In other embodiments the applicator cartridge 156 may be formed from plastic, metal, glass, etc.

Figure 7:
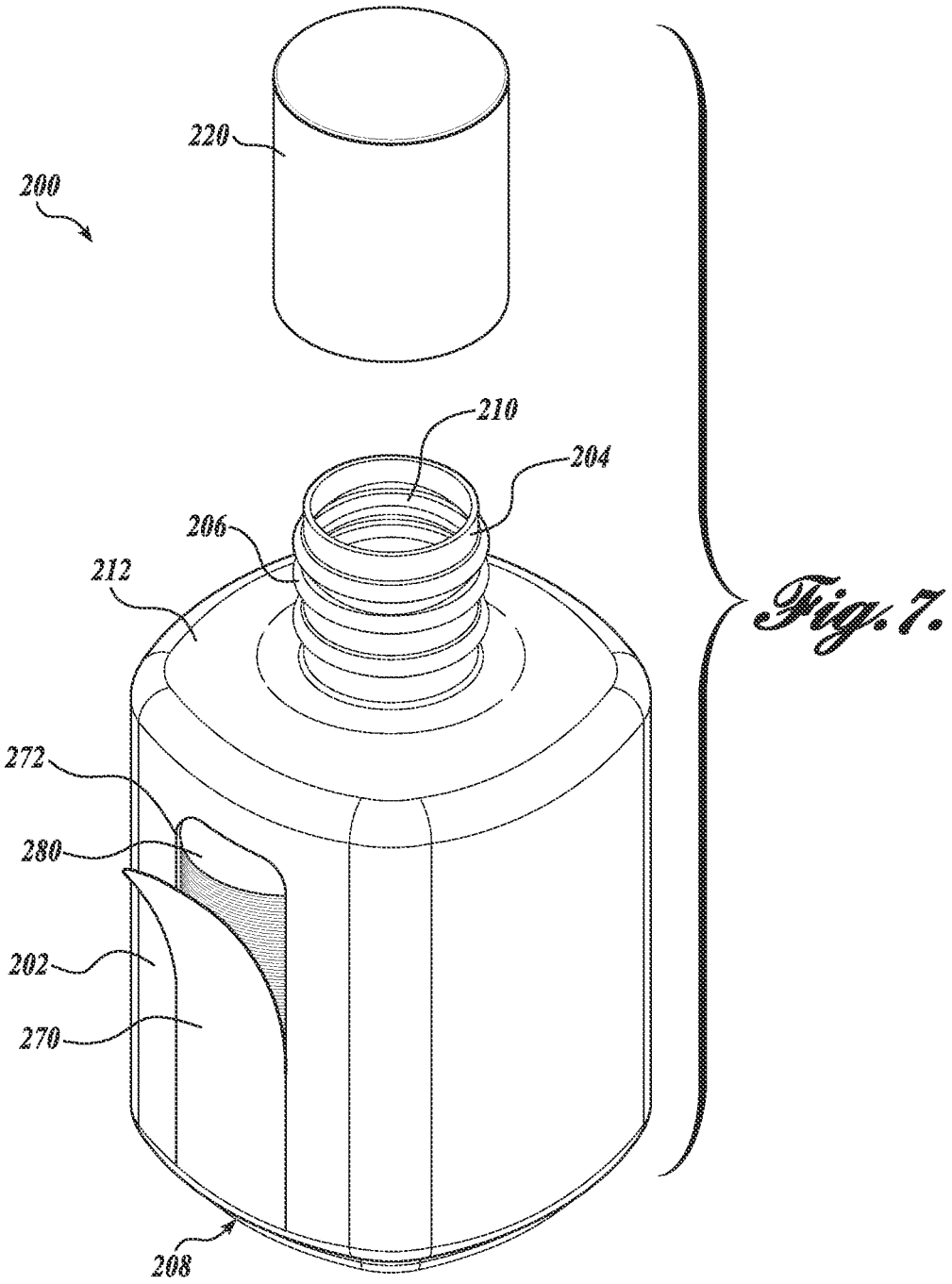
FIG. 7 is an exploded perspective view of another representative embodiment of a cosmetic formula container having a storage compartment in accordance with an aspect of the present disclosure.

Turning to FIG. 7, another embodiment of the cosmetic formula container is shown. The embodiments in FIG. 7 is substantially similar to the embodiment shown FIGS. 1-6, but is shown with like features in the 200-series which corresponds to the features in FIGS. 1-6, which are numbered in 100-series. As shown, a cosmetic formula container 200 includes a cosmetic bottle 202 having a neck 204, bottle threads 206, a base 208, a bottle cavity 210, and a bottle body 212. The cosmetic bottle 202 includes a cap 220 to retain the cosmetic formula within the cosmetic bottle 202.

In the illustrated embodiments, the cosmetic bottle 202 includes a protrusion extending from a side of the bottle body 212 into the bottle cavity 210 to form an applicator compartment 272. The applicator compartment 272 has a closed distal end such that the cosmetic formula in the bottle cavity 210 does not enter the applicator compartment 272. The depth of the applicator compartment 272 is suitably any depth to hold a desired number of applicators 280. In the embodiment shown, the applicator compartment 272 is configured such that a stack of applicators 280 may be retained within the applicator compartment 272. In these embodiments, the opening of the applicator compartment 272 may be smaller than the diameter of the applicators 280 such that the applicators 280 must be deformed to insert into the applicator compartment 272. In this regard, the applicators 280 will be substantially retained within the applicator compartment 272. In some embodiments, as shown in FIG. 7, the applicator compartment 272 may include a releasable cover 270, for example, a label or resealable sticker to enclose the applicator compartment 272.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward." "rearward," "front," "back," "upward," "downward," "right hand," "left hand," "lateral." "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately." etc., means plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A cosmetic formula container, comprising:

a container body configured to retain a portion of a cosmetic formula within a cavity, the container body having a neck configured to receive a cap for closure of the container body;

an indentation extending from a base portion of the container body into the cavity to form a compartment having an open proximal end and closed distal end such that the cosmetic formula in the cavity does not flow into the compartment, the compartment having a profile configured to retain a plurality of applicators therein; and a plurality of applicators are stacked within the compartment, each of the applicators comprises a thin sheet, each of the plurality of applicators is deformed which retains each of the applicators within the compartment, and the proximal end of the compartment is open without a cover.

2. The cosmetic formula container of claim 1, wherein a profile of the compartment has a shape selected from the group consisting of oval, elliptical, non-circular, and arcuate.

3. The cosmetic formula container of claim 2, wherein the profile is oval or elliptical and each of the plurality of applicators is deformed similarly into a hyperbolic paraboloid shape in the stack.

4. The cosmetic formula container of claim 1, wherein the indentation is centered in the base portion.

5. The cosmetic formula container of claim 1, wherein the indentation is offset from the center in the base portion.

6. The cosmetic formula container of claim 1, wherein the indentation is non-circular, and the applicators are circular.

7. The cosmetic formula container of claim 1, wherein the indentation is circular, and the applicators are non-circular.

8. The cosmetic formula container of claim 1, wherein each applicator has a top side and a bottom side, and a bottom side of an applicator rests on a top side of a juxtaposed applicator.

9. The cosmetic formula container of claim 8, wherein each applicator is similarly sized, wherein the bottom side of an applicator wholly rests on the top side of the juxtaposed applicator.

10. A cosmetic formula container, comprising:

a container body configured to retain a portion of a cosmetic formula within a cavity, the container body having a neck configured to receive a cap for closure of the container body; and an indentation extending from the container body into the cavity to form a compartment having an open proximal end and closed distal end such that the cosmetic formula in the cavity does not flow into the compartment, the compartment having a profile configured to retain a plurality of applicators therein; and a cartridge having a cooperating shape with the compartment such that the cartridge is configured to insert within the compartment, wherein the cartridge is configured to retain the plurality of applicators, wherein the cartridge comprises a bottom wall and a side wall extending upright from the bottom wall.

11. The cosmetic formula container of claim 10, wherein the cartridge has a retention feature to retain the cartridge within the compartment, the retention feature selected from the group consisting of interference fit, snap fit, thread, and twist to lock.

12. A cosmetic formula container, comprising:

a container body configured to retain a portion of a cosmetic formula within a cavity, the container body having a neck configured to receive a cap for closure of the container body; and an indentation extending from the container body into the cavity to form a compartment having an open proximal end and closed distal end such that the cosmetic formula in the cavity does not flow into the compartment, the compartment having a profile configured to retain a plurality of applicators therein; wherein the indentation is in a side portion of the container body to form the compartment, wherein each applicator is a thin sheet of material, and the plurality of applicators are in a stack.

13. The cosmetic formula container of claim 12, wherein an opening of the indentation in the side portion of the container body is narrower than the plurality of applicators such that the applicators are retained within the compartment by interference.

14. The cosmetic formula container of claim 12, further comprising a removable cover over an opening of the indentation to enclose the compartment and retain the plurality of applicators therein.

* * * * *